United States Patent [19]

Langhart et al.

[11] Patent Number: 4,783,934

[45] Date of Patent: Nov. 15, 1988

[54] FREE-STANDING ASSEMBLY AND METHOD FOR MAKING SAME

[75] Inventors: Chris Langhart, New Hope, Pa.; Michael H. Brown, Monrovia, Calif.

[73] Assignee: United Production Services, Inc., Duarte, Calif.

[21] Appl. No.: 934,234

[22] Filed: Nov. 21, 1986

[51] Int. Cl.[4] ..... E04H 3/10

[52] U.S. Cl. ..... 52/64; 52/6; 52/7; 52/66; 52/118; 52/121; 52/126.1; 52/126.6; 272/22; 187/24; 254/89 R; 254/103

[58] Field of Search ..... 52/6, 645, 646, 221, 52/125.1, 726, 126.5, 126.1, 118, 117, 111, 66, 7, 71, 120, 121, 64; 187/8.59, 24, 25, 9 E, 63, 141; 254/7 R, 7 C, 47, 48, 89 R, 103; 272/21, 22

[56] References Cited

U.S. PATENT DOCUMENTS

| | | | |
|---|---|---|---|
| 39,689 | 8/1863 | Tanner | 52/118 X |
| 2,257,770 | 10/1941 | Szego . | |
| 2,534,852 | 12/1950 | Butts . | |
| 3,361,456 | 1/1968 | Durand | 52/118 |
| 3,417,518 | 12/1968 | Jaffe | 52/66 X |
| 3,449,872 | 6/1969 | Craighead et al. | 52/66 |
| 3,519,306 | 7/1970 | Young | 52/66 |
| 3,830,031 | 8/1974 | Soisson . | |
| 4,232,488 | 11/1980 | Hanley . | |
| 4,484,421 | 11/1984 | Williams et al. | 52/6 |
| 4,512,117 | 4/1985 | Lange | 52/6 |
| 4,600,085 | 7/1986 | Gagnon et al. | 272/22 X |
| 4,638,604 | 1/1987 | Rogers et al. . | |
| 4,657,112 | 4/1987 | Ream et al. | 52/118 X |

FOREIGN PATENT DOCUMENTS

| | | | |
|---|---|---|---|
| 362627 | 10/1922 | Fed. Rep. of Germany | 52/7 |
| 2935544 | 3/1981 | Fed. Rep. of Germany | 52/7 |
| 27000 | of 1890 | United Kingdom | 52/7 |

*Primary Examiner*—David A. Scherbel
*Assistant Examiner*—Richard E. Chilcot, Jr.
*Attorney, Agent, or Firm*—Kenyon & Kenyon

[57] ABSTRACT

A roof assembly exemplarily for use in outdoor theatrical and musical productions comprises a roof trusswork elevated by means of a plurality of telescoping legs. The legs are raised in unison so that the roof trusswork maintains the same orientation throughout a raising or lowering operation. A clamping or locking mechanism is provided for rigidifying the entire structure upon the raising thereof.

23 Claims, 3 Drawing Sheets

FREE-STANDING ASSEMBLY AND METHOD FOR MAKING SAME

BACKGROUND OF THE INVENTION

This invention relates to a roof assembly. This invention also relates to a method for producing a roof assembly.

FIELD OF THE INVENTION

Temporary roofs for outdoor stages and other public performance platforms, e.g., boxing arenas, generally take the form of a frame or trusswork covered by a tarpaulin and suspended in the manner of a picture frame from two, large scaffolding structures.

Such a conventional roof, together with the underlying stage or platform, requires several days to build. In view of increasingly tight scheduling of performances and other public presentations in the available public assembly places, a need has developed for a stage and roof combination which can be constructed in a short period of time. In some applications, e.g., indoor concerts and similar exhibitions, a trusswork will be erected to support a sound system, lighting or the like with or without a platform or stage. Of course, the same considerations of fast, economical erection of a strong, safe and secure structure also apply. In addition, inasmuch as theatrical and musical performances and other entertainment events are frequently presented in private areas, rather than in public assembly places, a need for quieter assembly procedures has been recognized.

Considerable time and energy has been devoted to designing portable or traveling stages. For example, U.S. Pat. No. 4,026,076 to Analetto discloses a portable stage with a supporting structure extending lengthwise of a trailer designed for highway travel. The supporting structure includes a plurality of longitudinally spaced parallel joints each supported along a central section by the trailer and at the ends by adjustable supports each including a ground engaging pad and manually adjustable jacks.

U.S. Pat. No. 4,484,421 to Williams et al. is directed to a stage assembly for a traveling show. A roof trusswork is assembled and raised by means of cables which are wound partially around pulleys or drums at the tops of vertical columns. At their ends opposite the trusswork, the cables are attached to manual winding sheaves. The trusswork is first raised to head height for the attachment of lights, curtains and scenery props. Subsequently, the trusswork is elevated to roof height over a stage platform.

U.S. Pat. No. 3,417,518 to Jaffe shows and describes a foldable stage carried by a trailer. The stage floor is stabilized by means of a plurality of jacks, while the roof is supported on side walls or legs each comprising a pair of support sections pivotally attached to one another in the center and at opposite ends to the stage platform and to the roof.

U.S. Pat. No. 4,512,117 to Lange discloses a modular theatre comprising transverse truss beams connected together by flat truss sections supported on columns.

Other fields which may have some relevance to stage roofs include the construction of roofs for the storage of agricultural produce and the construction of temporary shelters for people and/or machinery such as airplanes. For example, U S. Pat. No. 3,172,740 to Elstner discloses a portable horizontal silo having a storage bin for holding and drying livestock feed. The storage bin is provided with a plurality of roof sections each supported by upper elongated members pivotably secured to the respective roof section and telescopically received in respective lower tubular members pivotably fastened at points alongside the storage bin walls.

U.S. Pat. No. 3,449,872 to Craighead et al. discloses an aircraft hanger, while U.S. Pat. No. 392,764 to Thomas shows a roof structure supported at an adjustable vertical height on four uprights or posts.

SUMMARY AND OBJECTS OF THE INVENTION

An object of the present invention is to provide a trusswork that can be quickly and economically erected for suspending or hanging a roof, sound system and/or lighting or the like with or without a rigidly connected platform or stage for providing lateral stability and where lateral stability is provided by rigid connection of the trusswork to the upper ends of three or more legs.

Another object of this invention is to provide a platform or stage that enables substantially unobstructed viewing by an audience from any direction.

An object of the present invention is to provide an improved roof assembly of the above-described type exemplarily for use in stage productions.

Another, more particular, object of the present invention is to provide such a roof assembly which is easily and quickly assembled and disassembled.

Another particular object of the present invention is to provide such a roof assembly which can be constructed with a reduced amount of noise.

An additional object of the present invention is to provide such an improved roof structure wherein the roof can be supported at an easily varied height above a ground surface or platform.

A further object of the present invention is to provide such a roof assembly wherein the attachment of lights, curtains, stage props and other devices to a roof trusswork is facilitated.

A further object of the present invention is to provide an improved method for constructing a temporary roof exemplarily for use in stage productions.

The present invention provides a free-standing assembly comprising a substantially horizontally oriented trusswork and three or more rigidly connected telescoping legs for adjustably supporting the trusswork in a substantially horizontal position above a ground surface and/or a platform. Automatic actuator means are operatively coupled to the legs for alternately extending and collapsing the legs to alternately raise and lower the trusswork, while connections are provided for rigidly attaching an upper end of three or more of the legs to the trusswork along an edge thereof.

Pursuant to further features of the present invention, each telescoping leg may comprise a plurality of hollow leg members, while the automatic actuator means may include a plurality of devices such as cofunctioning screw and nut mechanisms equal in number to the legs and disposed inside the hollow leg members. Each of the automatic actuator devices advantageously further includes a drum and a cable wound about the drum, the cable being fastened at one end to a first leg member and at an opposite end to a second leg member telescopingly mating with first leg member. The cofunctioning screw and nut assembly is preferably disposed in a lowermost one of the leg members, that leg member having a diameter smaller than each other leg member comprising the respective leg.

Preferably, the legs are four in number and are disposed in pairs at opposite sides of the trusswork. However, it is to be understood that in certain situations one leg on each of two or three sides of the trusswork may be sufficient.

In an especially advantageous embodiment of the present invention, the automatic actuator means is designed to ensure that each of the automatic actuator devices operates at substantially the same rate, i.e., a common rate, as the other devices so that the trusswork undergoes only translational motion during raising and lowering operations. This embodiment of the present invention is specifically realized in the form of motors operating the several cofunctioning screw and nut mechanisms, the motors being connected to the same voltage source, whereby the rates at which the nuts are displaced with respect to the associated screws are substantially the same.

In accordance with a particular feature of the present invention, the roof assembly further comprises locking mechanisms for clamping the leg members of any given leg to each other in a raised state of the trusswork. Each of the locking mechanisms advantageously includes a plurality of cam elements each engageable with a respective pair of the leg members.

The present invention also provides a method for constructing a roof which may be temporary and comprises the steps of (a) providing a trusswork, (b) providing a plurality of telescoping legs, at least two of the legs having a first length in a fully collapsed condition and a second length in a fully extended condition, (c) giving the trusswork a substantially horizontal orientation, (d) elevating and holding the trusswork at a vertical position at least as high as the first length, and (e) rigidly attaching an upper end of each of the legs to the trusswork along an edge thereof. In a subsequent step (f), the legs are automatically extended at a first common rate to elevate the trusswork, whereby the trusswork undergoes only translational motion during a raising operation. Subsequently to the leg extension step, the legs may be automatically collapsed at a second common rate (usually equal to the first common rate or speed) to lower the trusswork. Devices such as lights, curtains and stage props may be attached to the trusswork in a lowered position thereof.

DETAILED DESCRIPTION

Figure 1:
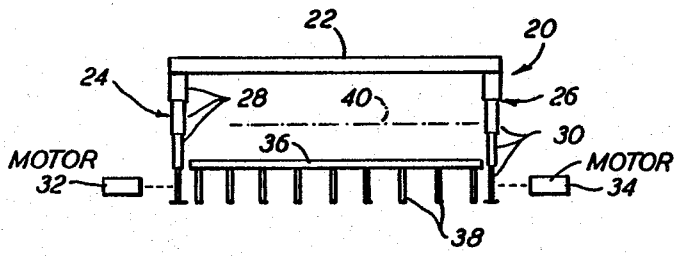
FIG. 1 is a schematic front elevational view of a roof assembly in accordance with the present invention.

As illustrated schematically in FIG. 1, a roof assembly 20 comprises a trusswork 22 defining a substantially flat prism supported at each of two opposite edges by one or more telescoping legs 24 and 26. Each telescoping leg 24 comprises a plurality of hollow leg members 28 at least partially received in one another, the largest of the leg members being rigidly attached to roof trusswork 22. Each leg 26 similarly comprises a plurality of hollow leg segments or members 30 telescopingly received inside one another, the largest leg member being rigidly attached to roof trusswork 22. Motors 32 and 34 are operatively coupled to respective leg 24 and 26 for alternately extending and collapsing legs 24 and 26 to alternately raise and lower roof trusswork 22.

Legs 24 and 26 support trusswork 22 above a stage or platform 36 in turn spaced vertically from a ground surface by support posts 38. Legs 24 and 26 may be partially collapsed into one another to adjust the height at which trusswork 22 is disposed above stage or platform 36. For example, trusswork 22 may be positioned at a vertical level 40 suitable for the attachment of lights, curtains and stage props to the trusswork by stage hands standing on platform 36.

In constructing the stage and roof assembly illustrated in FIG. 1, trusswork 22 is initially assembled and given a substantially horizontal orientation on a ground surface. Telescoping legs 24 and 26, which are prefabricated units, are attached to the sides or edges of trusswork 22 upon the elevation thereof (e.g., by forklifts) to a height approximately equal to the lengths of legs 24 and 26 in a fully collapsed thereof. The rigid attachment of the legs to trusswork 22 is important, inasmuch as the stability of the roof assembly depends upon the rigidity of the connections. Upon the construction of the stage roof, the legs are extended at substantially the same rate to raise the trusswork without any rotation thereof. Upon the raising of trusswork 22 to a predetermined level, stage 36 is assembled on the ground below the roof structure. The height of the roof structure may then be adjusted to enable the attachment of the various devices to trusswork 22. A tarpaulin or other water impervious cover (not illustrated) is attached to trusswork 22 along an upper side thereof.

Figure 2:
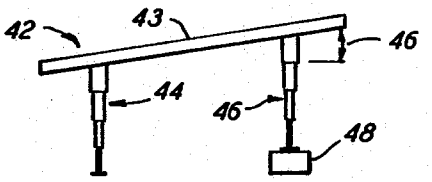
FIG. 2 is a schematic side elevational view of another roof assembly in accordance with the present invention.

As depicted in FIG. 2, another roof assembly 42 in accordance with the present invention includes a roof trusswork 43 inclined at an angle 46 with respect to the horizontal. Trusswork 43 is supported on each side by a telescoping upstage leg 44 and a telescoping downstage leg 46. During raising and lowering operations, legs 44 and 46 extend at substantially the same rate. All of the legs 44 and 46 have substantially the same length in an extended configuration, while the front or downstage legs 46 are supported on respective blocks 48 to give the downstage portion of roof assembly 42 an elevated vertical position relative to the upstage portion of the roof assembly.

Figure 3:
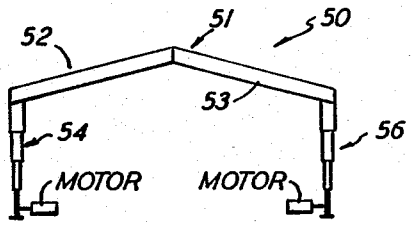
FIG. 3 is a schematic front elevational view of yet another roof in accordance with the present invention.

As illustrated in FIG. 3, another roof assembly 50 comprises a roof trusswork 51 having a first half 52 and a second half 53 attached along a center line to one another and at opposite sides to legs 54 and 56. Roof halves 52 and 53 are inclined with respect to one another, whereby roof trusswork 51 takes the form of a shallow inverted V.

Each of the roof trussworks 22, 43 and 51 has a substantially horizontal orientation. The telescoping supporting legs preferably have rectangular cross-sections. However, other cross-sections, e.g., circular, are possible.

Figure 4:
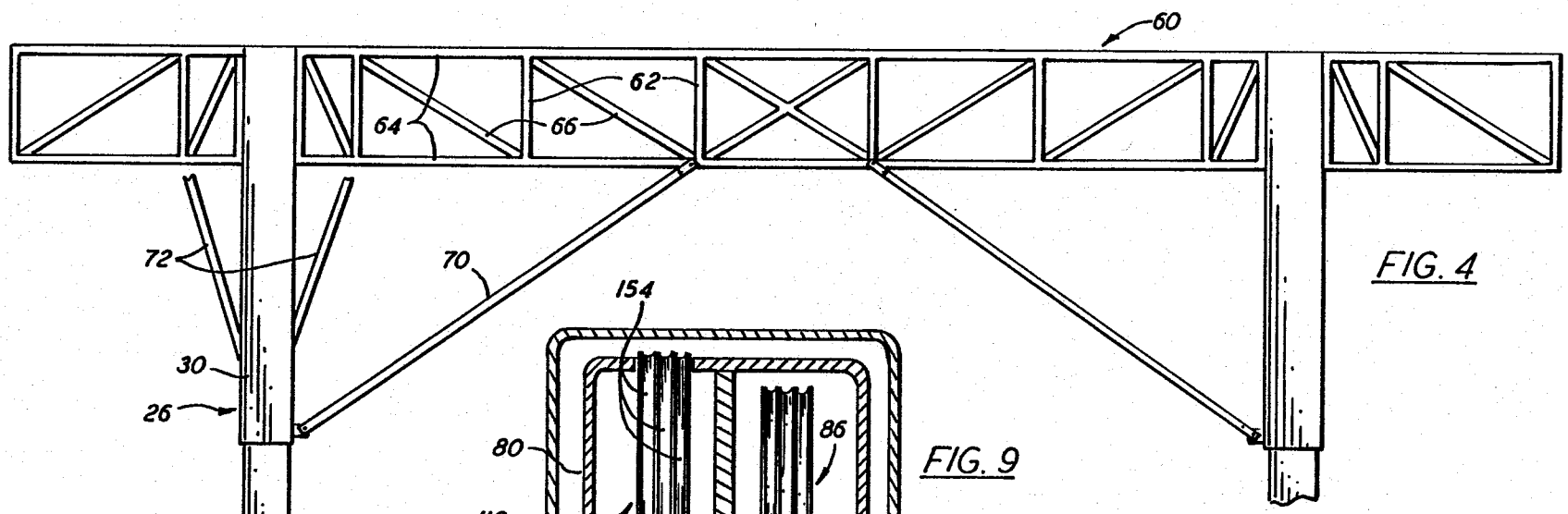
FIG. 4 is a partial side elevational view of the roof assembly illustrated in FIG. 1.

FIG. 4 is a partial side elevational view of a side of the roof assembly 20 of FIG. 1. As depicted in FIG. 4, roof trusswork 22 includes a truss component 60 having a plurality of vertical bars 62 extending between two horizontal beams 64 connected to one another also by diagonal struts 66. Trusswork 22 comprises a plurality of truss components or parts 60, 74, 76 (see FIG. 5) each extending in a upstage-downstage direction and a plurality of cross pieces 78 each extending from stage left to stage right.

Figure 6:
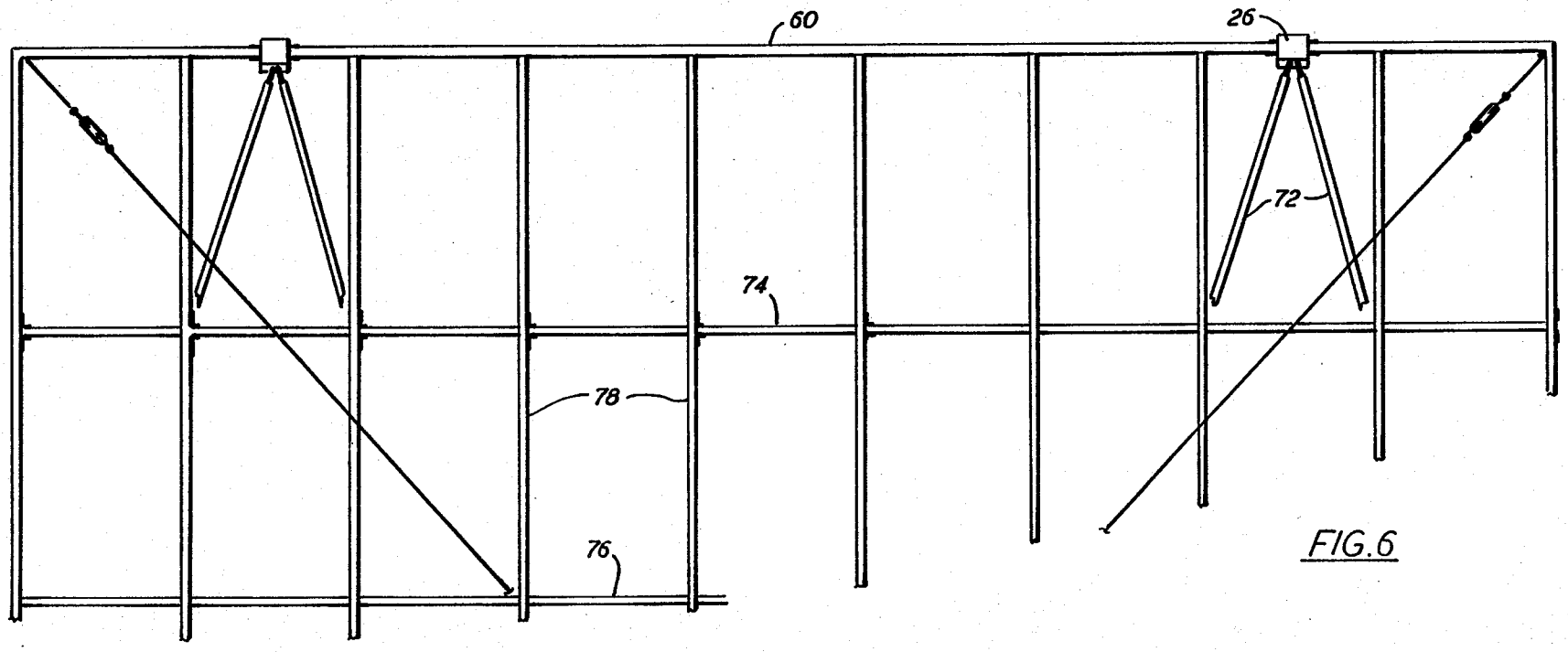
FIG. 6 is a top or plan view of a larger portion of the roof assembly of FIG. 1.
Figure 5:
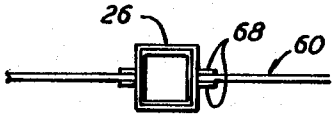
FIG. 5 is a top view of a portion of the roof assembly of FIGS. 1 and 4.

As illustrated in FIGS. 4 and 5, each leg 26 is connected to trusswork 22 and particularly to truss component 60, by means of a plurality of brackets or coupling elements 68. The rigidity of the coupling of each leg 26 to trusswork 22 is further ensured by the connection of a strut or brace 70 between the upper member 30 of the respective leg 26 and truss component 60. As shown in FIGS. 4 and 6, further struts or braces 72 may be connected at one end to a respective leg 26 and at an opposite end to trusswork 22 in the interior thereof. Each of the other legs 24 of roof assembly 20 is connected to trusswork 22 by brackets, struts and braces in a configuration like that of parts 60, 68, 70 and 72. The internal structures of roof assemblies 42 (FIG. 2) and 50 (FIG. 3) are similar to the structure of roof assembly 20 and will be clear to one skilled in the art.

Figure 7:
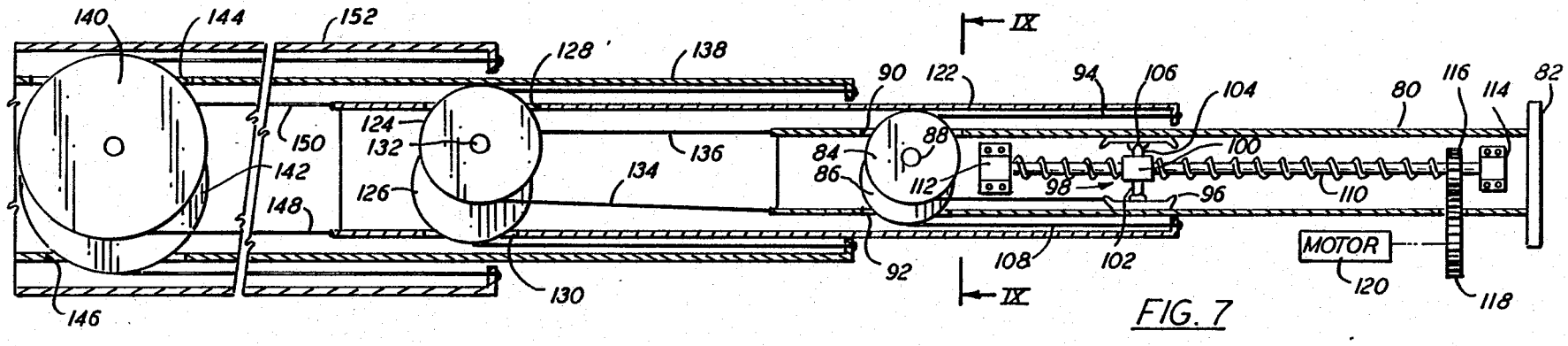
FIG. 7 is a longitudinal cross-sectional view of a telescoping leg of a roof assembly in accordance with the present invention.

FIGS. 7, 8, 9 and 10 illustrate an actuating mechanism by which each telescoping leg 24 and 26 (or 44 and 46, or 54 and 56) is automatically raised and lowered in unison with the other legs of the respective roof assembly in accordance with the invention. As depicted in FIG. 7, an innermost and preferably lowermost hollow leg member 80 is provided at an outer end with a foot pad or plate 82 and at an opposite end with a pair of pulleys or drums 84 and 86 rotatably mounted to the hollow leg member via respective shafts 88 (only one shown in the drawing). Pulleys 84 and 86 have the same diameter but are offset from one another so that pulley 84 protrudes through an opening 90 on one side of leg member 80 while pulley 86 protrudes through an opening 92 on an opposite side of the leg member.

Partially wound about pulley 84 is a cable 94 attached at one end to a foot or slide element 96 of a traveling actuator 98. Actuator 98 principally includes a nut (not illustrated) in a housing 100 and further includes a pair of legs or brackets 102 and 104 projecting from opposite sides of housing 100 and pivotably attached at their outer ends to respective feet or slide elements 96 and 106.

Partially wound about pulley 86 is a cable 108 attached to traveling actuator 98 at leg 102. Although cables 94 and 108 can be attached to either the slider elements 96 and 106 or the leg brackets 102 and 104, it is preferable that they be connected to the latter.

As shown in FIG. 7, the nut of traveling actuator 98 meshes with a screw 110 rotatably journaled in respective end brackets 112 and 114 attached to leg member 80. At an end opposite pulleys 84 and 86, worm or screw 110 is provided with a gear 116 meshing with another gear 118 driven by a rotary motor 120. In the case that the leg illustrated in FIG. 7 is a leg 24 or 26 in FIG. 1, motor 120 is identical to motor 32 or 34.

At their ends opposite traveling actuator 98, cables 94 and 108 are connected to the outer end of a second telescoping leg member 122 in which leg member 80 is partially inserted. At an inner end, leg member 122 is provided with a pair of pulleys 124 and 126 staggered with respect to one another so that pulley 124 projects through a first opening 128 on one side of leg member 122, while pulley 126 projects through a second opening 130 on an opposite side of that leg member. Pulleys 124 and 126 are rotatably mounted via respective shafts 132 (only one shown) to hollow leg member 122. Cables 134 and 136 are partially wrapped about pulleys 124 and 126 and are each connected at their opposite ends to an inner end of leg member 80 and to an outer end of a third hollow leg member 138.

Two pulleys 140 and 142 rotatably journaled at an inner end of leg member 138 are offset with respect to one another in a transverse direction, whereby pulley 140 projects through a first aperture 144 on one side of leg member 138 and pulley 142 projects through a second aperture 146 on an opposite side of the leg member. Cables 148 and 150 partially wound about pulleys 140 and 142 are connected at opposite ends to leg member 122 and a fourth hollow leg member 152.

Figure 8:
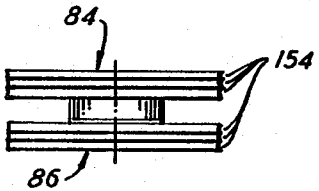
FIG. 8 is a side elevational view of two pulleys shown in FIG. 7.

As shown in FIG. 8, pulleys 84 and 86 have the same diameter and advantageously include three grooves 154 for the reception of respective cables. Accordingly, each cable 94 and 108 in FIG. 7 is preferably accompanied by two additional cables (not illustrated) so that six cables in total are provided for connecting traveling actuator 98 to leg member 122. The other pulleys shown in FIG. 7 are also advantageously provided with multiple grooves in which respective cables are received.

During a trusswork elevating operation, motor 120 is energized to rotate gears 118 and 116 and screw 110 so that actuator 98 travels in an axial or longitudinal direction along screw 110 from pulleys 84 and 86 towards gears 116. This motion causes cables 94 and 108 to pull leg member 80 out of leg member 122. Similarly, cables 134 and 136 cooperate with pulleys 124 and 126 to pull leg member 122 longitudinally out of leg member 138, while leg member 138 is extracted from leg member 152 through the action of cables 148 and 150. During a trusswork lowering operation, motor 120 is energized in an opposite direction, which enables the weight of the roof assembly to collapse leg members 80, 122, 138 and 152 into one another Inasmuch as the parts provided in the telescoping legs (e.g., legs 24 and 26 in FIG. 1) for extending and collapsing the legs are identical to one another and inasmuch as the energizing motors are all connected to the same a-c power source, the extension and collapsing of the respective legs occur at the same rate, whereby the trusswork (e.g., trusswork 22) retains the same orientation throughout.

Figure 10:
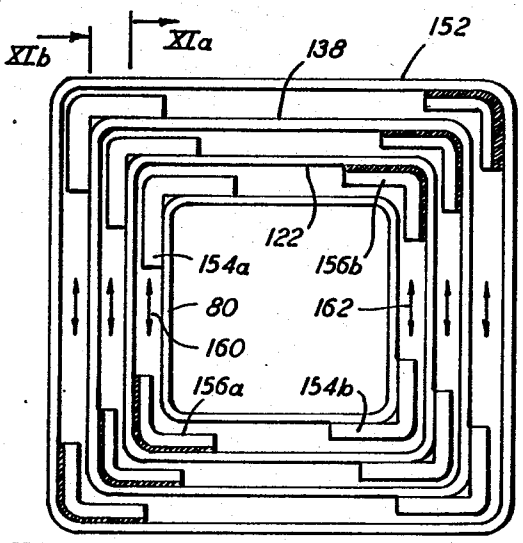
FIG. 10 is a partial bottom view of the telescoping leg shown in FIG. 7, taken from the right-hand side of that drawing figure, with a bottom plate and other elements removed for purposes of clarity.
Figure 9:
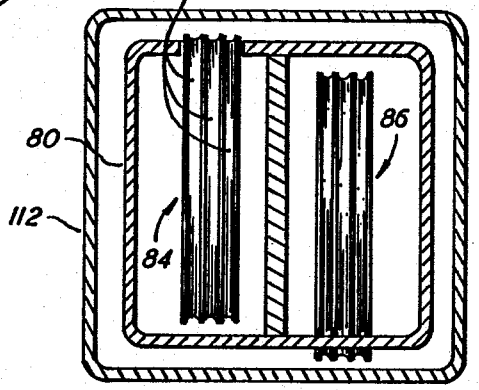

As illustrated in FIG. 10, inner leg member 80 is spaced from second leg member 122 by at least two pairs of angular buffer elements **154*a*, 154*b* and 156*a*, 156*b*. Elements 154*a* and 154*b* are attached along inner surfaces to an outer surface of hollow leg member 80 and lie diagonally across from one another, while buffer elements 156*a* and 156*b* are attached along outer surfaces to an inner surface of leg member 122 and are likewise disposed diagonally opposite one another. Similar angular buffer elements (not designated with reference numerals in the drawing) arranged in diagonal pairs serve to separate leg member 122 from leg member 138 and the latter from leg member 152**.

As indicated by an arrow 160 in FIG. 10, a camming mechanism (illustrated in detail in FIGS. 11 and 12) is provided between leg members 80 and 122 and between angle elements 154*a* and 156*a* for pushing leg member 80 transversely with respect to leg member 122 to clamp the leg members with respect to one another and to thereby rigidify their coupling and prevent bending of the respective leg upon the elevation of the trusswork to a desired vertical position. An identical camming mechanism is provided, as indicated by an arrow 162 in FIG. 10, between leg members 80 and 122 and between angle elements 154*b* and 156*b*. Other arrows in FIG. 10 represent further camming mechanisms for locking or clamping leg member 122 to leg member 138 and leg member 138 to leg member 152.

Figure 11:
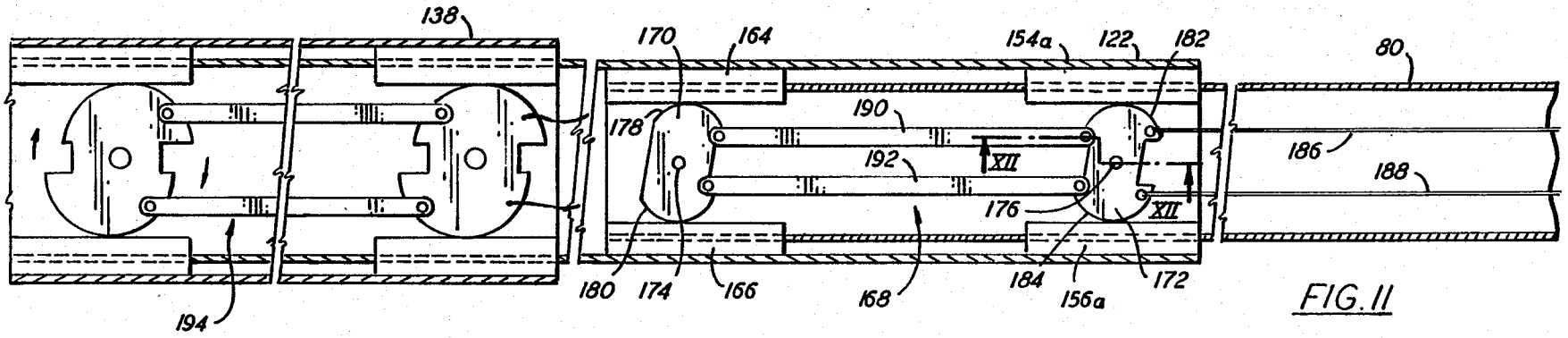
FIG. 11 is a cross-sectional view partially taken along line XIa—XIa and partially along line XIb—XIb in FIG. 10.

A right-hand portion of FIG. 11 is a partial cross-sectional view taken along line XIa—XIa in FIG. 10, while the left-hand side of FIG. 11 is a partial cross-sectional view taken along line XIb—XIb in FIG. 10. As illustrated in FIG. 11, two further pairs of angular buffer elements 164 and 166 (only one member of each pair being visible in the drawing) may be disposed between leg member 80 and leg member 122 for spacing those elements from one another. As heretofore described with respect to the angular buffer elements depicted in FIG. 10, elements 164 are disposed diagonally with respect to one another and are attached along inner surfaces to an outer surface of tubular leg member 80. Angular buffer elements 166 are likewise disposed angularly with respect to one another and are attached along outer surfaces to an inner surface of tubular leg member 122.

As shown in FIG. 11, a camming mechanism 168 for executing the motion indicated in FIG. 10 by arrow 160 comprises two camming plates 170 and 172 rotatably fastened by means of respective pivot pins 174 and 176 to a wall of outer tubular leg member 122. Camming plate 170 has a pair of opposed cylindrical camming surfaces 178 and 180 having respective axes of symmetry spaced from one another on opposite sides of pivot pin 174. Similarly, camming plate 172 has a pair of circular or cylindrical camming surfaces 182 and 184 with respective axes of symmetry parallel to and spaced from one another and located on opposite sides of pivot pin 176.

Attached to camming plate 172 are a pair of cables 186 and 188 which dangle from camming plate 172 and which may be attached at their lower ends to respective levers (not illustrated). On a side opposite cables 186 and 188, a pair of tie rods 190 and 192 are pivotably connected to camming plate 172. At ends opposite camming plate 172, tie rods 190 and 192 are, in turn, pivotably connected to camming plate 180.

Upon a raising of a roof trusswork (e.g., trusswork 22 in FIG. 1) to an elevated operational position, tension is applied to cable 188 to rotate cam plates 172 and 170 (see arrows in FIG. 11) about pivot pins 176 and 174 in a counterclockwise direction as viewed in FIG. 11. Cylindrical camming surfaces 182 and 184 engage edges of buffer elements 154*a* and 156*a*, respectively, while cylindrical camming surfaces 178 and 180 of camming plate 170 engage edges of respective buffer elements 164 and 166, thereby urging inner tubular leg member 80 in a transverse direction towards one wall of leg member 122, as indicated by arrow 160 in FIG. 10. Camming mechanism 168 and five other similar camming mechanisms, such as camming mechanism 194 shown in FIG. 11 serve to clamp the leg members of a telescoping leg to one another in an operative raised position of a roof assembly. The camming mechansims eliminate transverse play between mating leg members (e.g., leg members 80 and 122) and rigidify or stiffen the entire structure.

Figure 12:
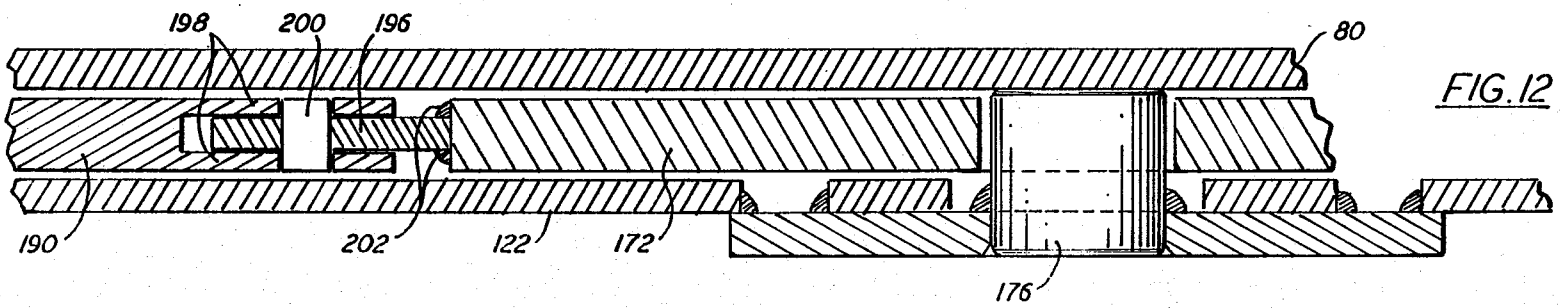
FIG. 12 is a partial cross-sectional view, on an enlarged scale, taken along line XII—XII in FIG. 11.

As illustrated in detail FIG. 12, camming plate 172 is provided in a region proximate to rods 190 and 192 with an extension or flange 196 having a smaller thickness than the body of camming plate 172. Each rod, e.g., rod 190, includes at one end a pair of prongs 198 between which extension or flange 196 is inserted. Rod 190 is pivotably connected to camming plate 172 by a pivot pin 200 traversing apertures in prongs 198 and extension 196. Extension 196 is welded at 202 to plate 172.

Figure 13:
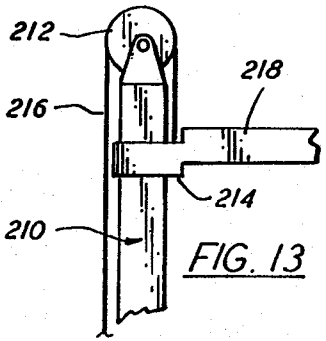

It will be appreciated by those skilled in the art that the operative rigid engagement of the trusswork to the legs in this invention which provides the required lateral stability can be also achieved by providing, e.g., a collar arrangement. For example, in FIG. 13 the uppermost end leg 210 is provided with pulley 212 and tubular collar 214 which slideably engages tubular leg 210. Trusswork 218 which is fixedly connected to collar 214 can be hoisted up and lowered down leg 210 on cable 216 which is driven by a motor (not shown) in the same manner as the telescoping legs described above. An essential feature of this embodiment is the rigid connection of the legs to the trusswork is at the uppermost ends of the legs which provides the necessary lateral stability without bulky structure that could obstruct the view of an audience and get in the way of performers.

Although the invention has been described in terms of particular embodiments and applications, one of ordinary skill in the art, in light of this teaching, can generate additional embodiments and modifications without departing from the spirit of or exceeding the scope of the claiming invention. For example, leg members 80, 122, 138 and 152 may be clamped to one another by a locking mechanism other than the series of camming actuators 168 and 194 described hereinabove with reference to FIGS. 10–12. In addition, it may be possible to effectuate a uniform extension of all the telescoping legs, e.g., legs 24 and 26, of a roof assembly by means other than the nut/screw and cable/pulley structure depicted in FIG. 7. Accordingly, it is to be understood, that the descriptions and illustrations herein are proffered by way of example to facilitate comprehension of the invention and should not be construed to limit the scope thereof.

What is claimed is:

1. A free-standing assembly comprising:

a substantially horizontally oriented trusswork;

support means for adjustably supporting said trusswork in a substantially horizontal position above a ground surface and a platform, said support means including at least three legs, said legs each comprise a plurality of telescoping hollow leg members wherein said lowermost one of said leg members has a diameter smaller than each other leg member comprising the respective leg;

automatic actuator means operatively coupled to said legs and trusswork for alternatively raising and lowering said trusswork, said actuator means comprising a plurality of devices equal in number to said legs, said devices being disposed inside said hollow leg members; and connecting means for rigidly attaching an upper end of said legs to said trusswork along an edge thereof to provide lateral stability.

2. The assembly set forth in claim 1 wherein each of said devices includes a cofunctioning screw and nut assembly.

3. The assembly set forth in clam 2 wherein each of said devices further includes a drum and a cable partially wound about said drum, said cable being fastened at one end to one of said leg members and at an opposite end to another of said leg members telescopingly mating with said one of said leg members.

4. The assembly set forth in claim 3 wherein said actuator means includes means for ensuring that said devices operate at substantially the same rate so that said trusswork undergoes only translational motion during raising and lowering operations.

5. The assembly set forth in claim 1 wherein each of the devices includes a cofunctioning drum and cable.

6. The assembly set forth in claim 5 wherein said cofunctioning screw and nut assembly is disposed in lowermost one of said leg members.

7. The assembly set forth in claim 6 wherein said legs are four in number, two of said legs being disposed at one side of said trusswork and another two of said legs being disposed at an opposite side of said trusswork.

8. The assembly set forth in claim 7, further comprising means for locking the leg members of each of said legs to each other in a raised state of said trusswork.

9. The assembly set forth in claim 7 wherein said trusswork has a front end and a rear end, said front end being higher than said rear end and said trusswork concomitantly being included at an angle with respect to a horizontal plane.

10. The assembly set forth in claim 9 wherein said means for locking includes a plurality of cam elements each engageable with a respective pair of said leg members.

11. The assembly set forth in claim 1 wherein said leg members have rectangular cross-sections.

12. The assembly set forth in claim 1 wherein each of said devices includes cofunctioning drums and cables.

13. The assembly set forth in claim 12 wherein said means for locking includes a plurality of cam elements each engageable with a respective pair of said leg members.

14. The assembly set forth in claim 1, further comprising means for locking the leg members of each of said legs to each other in a raised state of said trusswork.

15. The assembly set forth in claim 1 wherein said legs are four in number, two of said legs being disposed at one side of said trusswork and another two of said legs being disposed at an opposite side of said trusswork.

16. The assembly set forth in claim 1 wherein said trusswork has a front end and a rear end, said front end being higher than said rear end and said trusswork concomitantly being inclined at an angle with respect to a horizontal plane.

17. A roof assembly comprising:

a substantially horizontally oriented trusswork;

support means for adjustably supporting said trusswork in a substantially horizontal position above ground surface and a platform, said support means including a plurality of telescoping legs, said legs further comprising a plurality of hollow leg members wherein said lowermost one of said leg members has a diameter smaller than each other leg member comprising the respective leg;

automatic actuator means operatively coupled to said legs for alternately extending and collapsing said legs to alternately raise and lower said trusswork, said actuator means including means for ensuring that said legs extend at a first common rate and collapse at a second common rate so that said trusswork undergoes only translational motion during raising and lowering operations, said automatic actuator means including a plurality of devices equal in number to said legs, said devices being disposed inside said hollow leg members; and connecting means for rigidly attaching an upper end of each said legs to said trusswork along an edge thereof.

18. The roof assembly set forth in claim 17 wherein each of said devices is a cofunctioning screw and nut assembly.

19. The roof assembly set forth in claim 17 wherein said legs are four in number, two of said legs being disposed at one side of said trusswork and another two of said legs being disposed at an opposite side of said trusswork.

20. The roof assembly set forth in claim 17 wherein said leg members have rectangular cross-sections.

21. The roof assembly set forth in claim 17 wherein each of said devices includes cofunctioning drums and cables.

22. A roof assembly comprising:

a substantially horizontally oriented trusswork;

support means for adjustably positioning and supporting said trusswork in a substantially horizontal portion above a ground surface and a platform, said support means including a plurality of telescoping legs, said legs further comprising a plurality of hollow leg members wherein said lowermost one of said leg members has a diameter smaller than each other leg member comprising the respective leg;

automatic actuator means operatively coupled to said leg for alternately extending and collapsing said legs to alternately raise and lower said trusswork, said actuator means further including means for ensuring that said legs extend at a first common rate and collapse at a second common rate so that said trusswork undergoes only translational motion during raising and lowering operations, said automatic actuators further including a plurality of devices equal in number to said legs, said devices being disposed inside said hollow leg members; and connecting means for rigidly attaching an upper end of each of said legs to said trusswork along an edge thereof.

23. A method for constructing a roof, comprising the steps of:

providing a trusswork;

giving said trusswork a substantially horizontal orientation;

providing a plurality of telescoping legs, at least two of said legs having a first length in a fully collapsed condition and a second length in a fully extended condition;

elevating and holding said trusswork at a vertical position at least as high as said first length;

rigidly attaching an upper end of each of said legs to said trusswork along an edge thereof;

automatically extending said legs at a first common rate to raise said trusswork, whereby said trusswork undergoes only translational motion during a raising operation;

subsequently to said step of automatically extending, automatically collapsing said legs at a second common rate to lower said trusswork, whereby said trusswork undergoes only translational motion during a lowering operating; and attaching devices to said trusswork in a relatively lowered position thereof.

* * * * *